United States Patent [19]

Rath et al.

[11] Patent Number: 4,915,570

[45] Date of Patent: Apr. 10, 1990

[54] BODY FOR A TRASH RECYCLING TRUCK

[75] Inventors: Albert Rath, Kitchener; Eugen J. Bexten, Ancaster; Gerald Liesemer, Maryhill, all of Canada

[73] Assignee: Compro Limited, Toronto, Canada

[21] Appl. No.: 315,823

[22] Filed: Jan. 27, 1989

[51] Int. Cl.[4] ..... B65F 3/04

[52] U.S. Cl. ..... 414/409; 298/23 C; 414/487

[58] Field of Search ..... 414/408, 409, 421, 422, 414/486, 487, 407; 296/184, 56

[56] References Cited

U.S. PATENT DOCUMENTS

| | | | |
|---|---|---|---|
| 3,030,139 | 4/1962 | Fite | 296/56 X |
| 3,175,712 | 3/1965 | Herpich et al. | 414/407 |
| 3,440,764 | 4/1969 | Cover | 296/56 X |
| 3,844,434 | 10/1974 | Blakeley et al. | 414/409 |
| 3,944,092 | 3/1976 | Ebeling et al. | 414/409 |
| 4,219,298 | 8/1980 | Stragier et al. | 414/409 |
| 4,840,531 | 6/1989 | Dinneen | 414/409 |

FOREIGN PATENT DOCUMENTS

| | | | |
|---|---|---|---|
| 2741448 | 3/1979 | Fed. Rep. of Germany | 414/407 |

*Primary Examiner*—Robert L. Spar
*Assistant Examiner*—Keith L. Dixon
*Attorney, Agent, or Firm*—Ridout & Maybee

[57] ABSTRACT

A body for a recycling truck has a plurality of interior movable partitions dividing the interior of the body into compartments. The partitions are hinged at their top edges to pivot rearward of the body. The partitions are locked using a pneumatically activated lever, and the partitions may be locked and unlocked remotely. A trough is located alongside the body, and the trough has removable buckets or movable interior partitions so that trough divisions correspond to the interior partitions of the body. The roof has a movable panel enabling the trough contents to be dumped within the body, and the trough is operated by a driven chain and sprocket mechanism located at either end of it.

16 Claims, 7 Drawing Sheets

BODY FOR A TRASH RECYCLING TRUCK

The present invention is a body for a truck which has the facility for collecting, transporting and delivering sorted trash for recycling.

With the growth in waste quantities and diminishing disposal site capacity, municipalities are under ever increasing pressure to initiate or expand recycling programs. Recycling is most effectively accomplished through residential collection utilizing relatively small recycling collection containers in conjunction with compartmentalized collection vehicles. The present invention is particularly useful in such community recycling programs in which household trash is sorted by members of the household rather than at a recycling centre. For the purpose of recycling greater amounts of trash from multi-residential dwellings and apartment buildings, larger wheeled carts are more practical to use than are the smaller containers typically used at the household level. These wheeled carts can be easily brought to a collection vehicle, but are too heavy to be manually emptied into the vehicle.

A single collection vehicle is required to service both houses and multi-residential dwellings, and the present invention is designed to address this need.

One vehicle presently in use employs a truck body which is compartmentalized and is provided with open sides for manual loading of sorted trash. The open sides have removable panels which can be added to raise the height of the sides to provide additional loading capacity as the compartments are filled. One disadvantage with this arrangement is that as the compartments are filled, it becomes increasingly difficult to manually load the body to its full capacity.

Top loading compartmentalized vehicles are also known, but these involve costly hydraulic lift mechanisms both for raising the roof of the truck body and for raising and emptying buckets containing the trash into the truck body. Frequently, the height reached by these lift mechanisms exceeds that of commonly encountered overhead wires or other structures.

Prior compartmentalized vehicles have compartments and containers for loading the compartments of fixed sizes, so that when one compartment is full, the truck must be taken to a recycling depot or site for emptying, even though the remaining compartments are not yet full. Productivity suffers when the vehicle does not permit the flexibility of variable compartment sizing, so that the vehicle may be loaded as full as possible before proceeding to the dump site.

Known compartmentalized truck bodies require a worker to enter the truck body to release each compartment partition in turn for sequential unloading of the compartments. This job can be dangerous, and is, at the very least, an unpleasant task.

The present invention provides a compartmentalized truck body which is top loading, but which does not cause the body components to extend to heights which may pose hazards to the workers on the truck and possible damage to property located above the truck. It is also directed to an apparatus to facilitate lifting and unloading of several buckets into corresponding compartments without the use of costly hydraulic lift mechanisms. Additionally, the mechanical features of the invention are designed to be energy efficient, cost effective and easily serviced in contrast to most prior known bodies of this type.

The present invention provides a truck body which is particularly adapted for use in a community recycling program. The truck body of the invention has a plurality of interior partitions which divide the interior space of the body into several compartments so that various types of trash can be simultaneously collected and segregated one from another. The truck body has a trough along one side which is subdivided in accordance with the interior compartmentalization of the body itself. Means are provided to guide and lift the trough vertically along the side of the body to a position above the body so that sorted trash may be dumped from the trough into the body compartments through an opening provided in the roof of the body.

The interior partitions for the body are hinged at their upper edges to allow the partitions to pivot towards the rear of the body, and each partition has means for locking it in place. Each interior compartment of the body can be emptied from the rear end of the body by remotely unlocking each partition sequentially and dumping the corresponding compartment contents. Preferably, the interior partitions for the body may be moved backwards or forwards to alter the size of the interior compartments, and interior dividers in the trough may be moved to corresponding positions. Alternatively, the trough may comprise a plurality of buckets attached to a trough frame, the buckets being interchangeable so as to correspond with the sizes of the various interior body compartments.

Accordingly, the present invention provides a body for a recycling truck having a plurality of interior partitions each extending substantially from the roof to the floor and wall to wall transversely of the body, thereby dividing the interior space of the body into a plurality of compartments. Each partition is hinged at its top edge to allow the partition to pivot toward the rear of the body. Means are provided for locking each interior partition in place. A movable panel is provided in the roof of the body which is activated by suitable means to provide access to the interior of the body substantially along the length of the roof. A trough extends along one side of the body. The trough defines a plurality of buckets positioned in corresponding relation to the interior partitions of the body. Guide and lift means are provided for moving the trough vertically along the side of the body from a position near the bottom of the side to an inverted position above the top of the side, the guide and lift means enabling the contents of the trough to be dumped into the partitioned interior of the body when the movable roof panel is opened.

BRIEF DESCRIPTION OF THE DRAWINGS

Referring to FIGS. 1 and 2, the present invention is directed to a recycling body 10 which is mounted on a truck chassis 12. The body 10 is pivotally attached to the rear of the chassis frame 14, and hydraulic lift means 16 are provided at the front of the frame 14 and body 10 to enable the body 10 to be tilted rearwardly so that contents of the body 10 may be dumped. The recycling body 10 has a roof 20, opposing sidewalls 30 and 32, front and rear walls 34 and 35, and a floor 36. The rear wall 35 has a pair of outwardly opening doors 37 hinged at the sides of the rear wall 35. The doors 37 provide access through a major portion of the rear wall 35.

Figure 1:
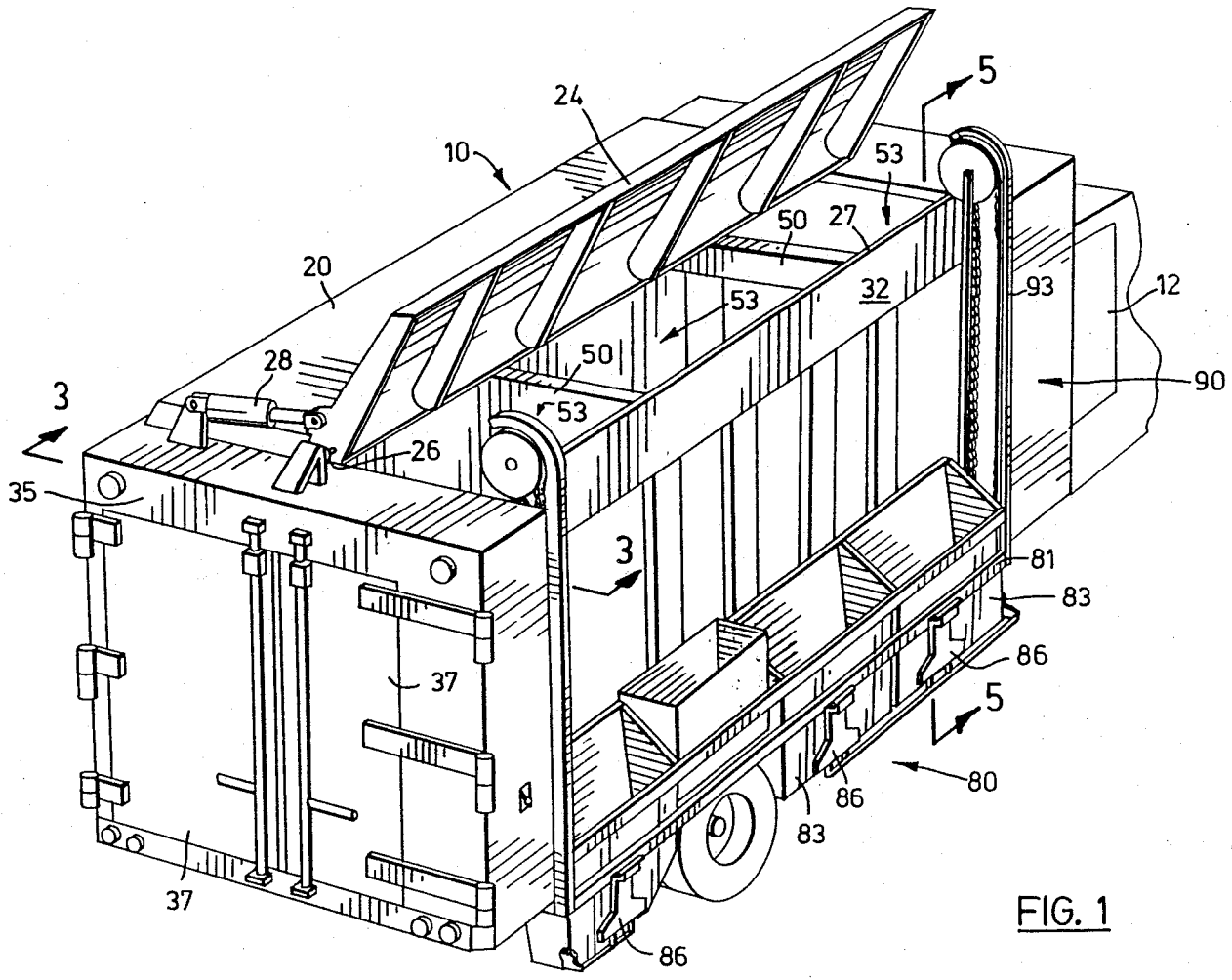
FIG. 1 is a rear perspective view of a truck body, according to the invention.

The roof 20 has a movable panel 24 preferably extending substantially along the length of the roof 20 and being hinged centrally of the roof 20, for example, by means of a pin and ball bearing arrangement 26 at either outward corner of the panel 24. The roof panel 24 may be opened upwardly from the top edge 27 of the sidewall 32 by means of a hydraulic cylinder 28 preferably located at the rear of the roof panel 24 as shown in FIG. 1.

The fully opened roof panel 24 provides access for the dumping of the trash into the compartmentalized interior of the body 10, and the opened panel 24 does not extend dangerously above the body 10. Generally, overhead wires and other structures extending over city streets are provided with a height clearance of at least 14 feet. The fully raised panel 24 does not extend beyond 13 feet 6 inches above the ground.

Figure 2:
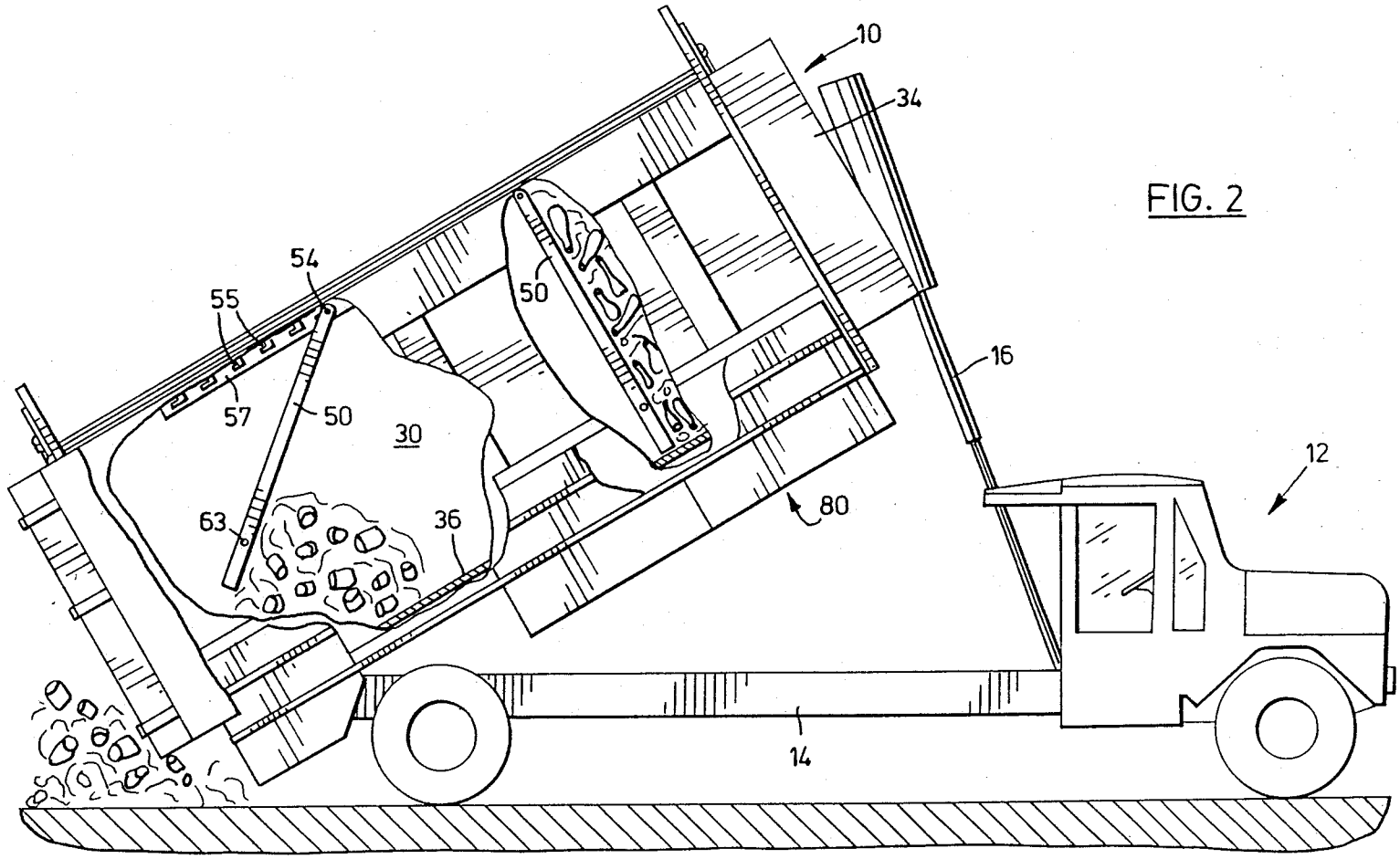
FIG. 2 is a side elevation partially broken away to show the operation of internal partitions of the body.
Figure 3:
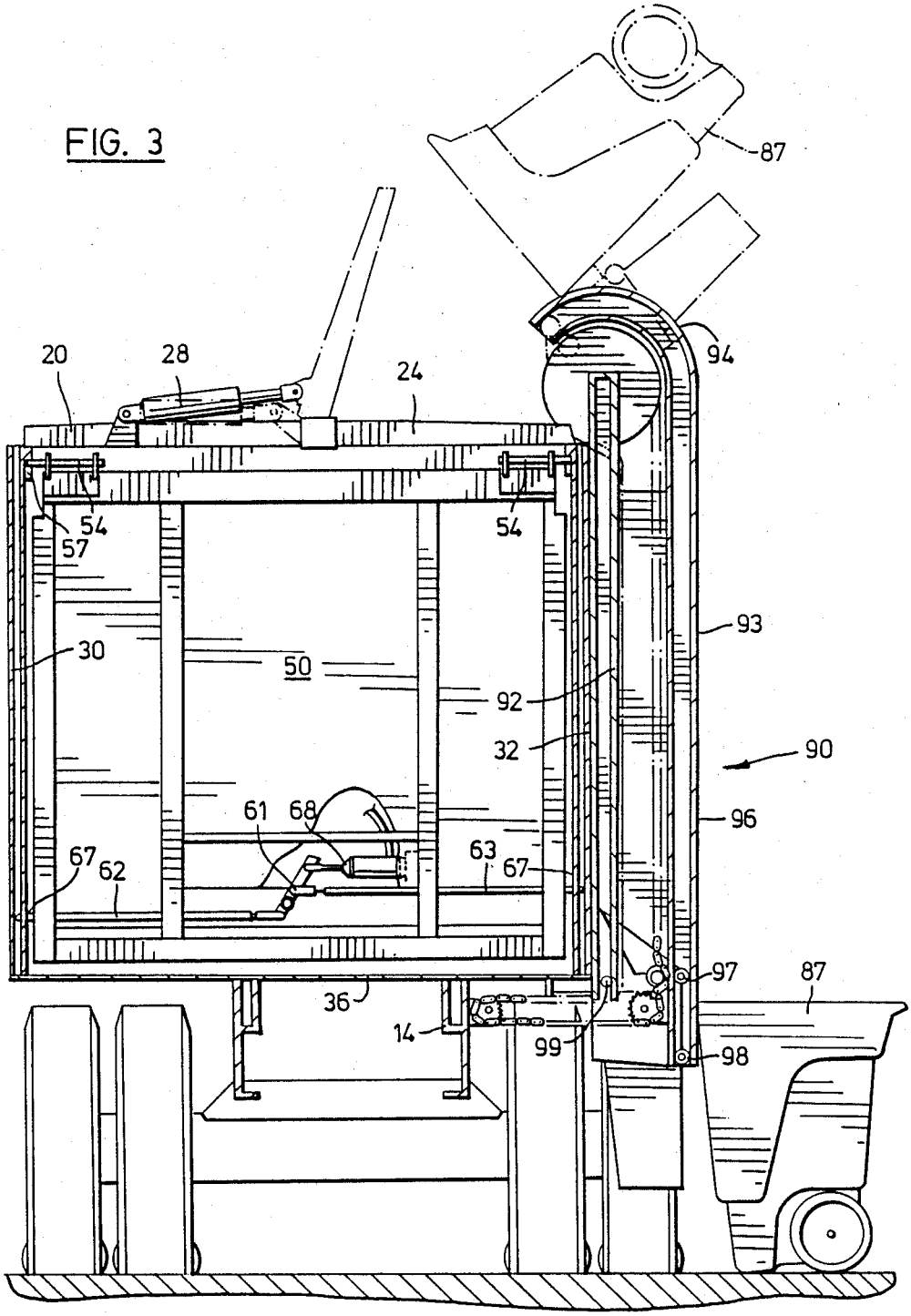
FIG. 3 is a cross sectional view through line 3—3 in FIG. 1 showing details of the operation of the invention.

Located internally of the body 10 are a plurality of partitions 50 which extend from the roof 20 to the floor 36 and from sidewall 30 to sidewall 32 transversely across the body 10, thereby defining a plurality of compartments 53, for receiving recyclable materials such as paper, glass and metal. As shown in FIGS. 2 and 3, each of the partitions 50 is pivotally connected to each sidewall 30 and 32 by means of a pin 54 extending from each top corner portion of each partition 50 into a slot 55 defined in a rail 57 extending along the top of each sidewall 30 and 32.

Figure 4:
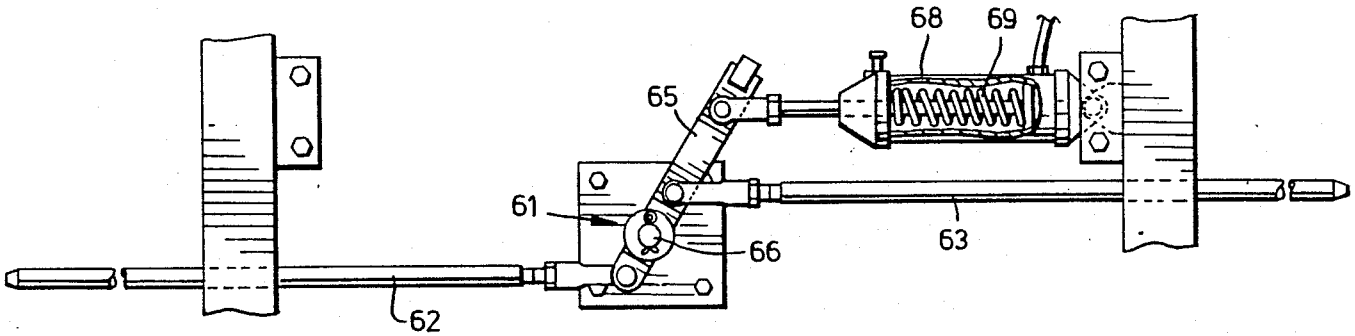
FIG. 4 is a detail side elevation, partly broken away, showing the locking mechanism for an internal partition.

In order to lock a partition 50 in place, each is fitted with a mechanical linkage 61 connected to locking rods 62 and 63. The linkage 61 preferably comprises an arm 65 attached to the partition 50 at a pivot 66 (FIG. 4). The locking rods 62 and 63 are pivotally attached to the arm 65 one on each side of the pivot 66. The linkage 61 operates to extend the rods 62 and 63 laterally beyond the side of each partition 50 so that the ends of the rods 62 and 63 engage pockets 67 formed in the opposing sidewalls 30 and 32 of the body 10. Pockets 67 formed in the sidewalls 30 and 32 of the body 10 are less likely to clog than floor pockets. This feature also leaves the floor 36 without holes, thereby eliminating leakage.

Means for operating the linkage 61 preferably comprises a push type air cylinder 68 having an internal coil spring 69 return. Control valves for the cylinder 68 are preferably remotely located in the cab of the truck and have detent positions for the cylinder 68 in the locked and unlocked positions.

To unlock a partition 50, air pressure is applied to the cylinder 68 retracting the locking rods 62 and 63 allowing the partition 50 to swing out of the way when the body 10 is raised to dump the contents of the compartment forward of the partition 50 as shown in FIG. 2. To lock a partition 50, the body 10 is lowered until the partition 50 is resting against a stop (not shown) on the floor 36, at which point the air in the cylinder 68 is exhausted, allowing the rods 62 and 63 to engage into the pockets 67 of the sidewalls 30 and 32 by the spring action 69 of the cylinder 68.

The partition 50 may be moved longitudinally forward or rearward in the truck body 10 in order to alter the size of the compartments 53. As shown in FIG. 2, tracks 57 are mounted along the upper inner edges of opposing walls 30 and 32. The tracks 57 are each provided with a plurality of slots 55. The slots 55 are preferably L-shaped in cross section. The pivot pins 54 of each internal partition 50 project laterally from opposite sides of each partition 50 into opposing slots 55 of the tracks 57. To alter the interior compartment sizes, a partition 50 is lifted to disengage the pivot pins 54 from the slots 55, and the partition 50 is moved along the tracks 57 to a new position for engagement of the pins 54 and slots 55.

A trough 80 is mounted on one side of the body 10 and comprises a frame 81 for holding a plurality of buckets 83. The buckets 83 are releasably attached to the frame 81 so that buckets of various sizes can be used and arranged in the frame 81 to correspond to the dimensions of the various internal compartments 53. The buckets 83 are held in the frame 81 by bolts (not shown). Alternatively, the trough 80 may be of a one piece construction having movable interior dividers.

The frame 83 is also provided with means 86 for attaching wheeled carts 87 to it. Various types of attachment means 86 such as spring loaded clamps, may be used depending on the particular application.

Figure 5:
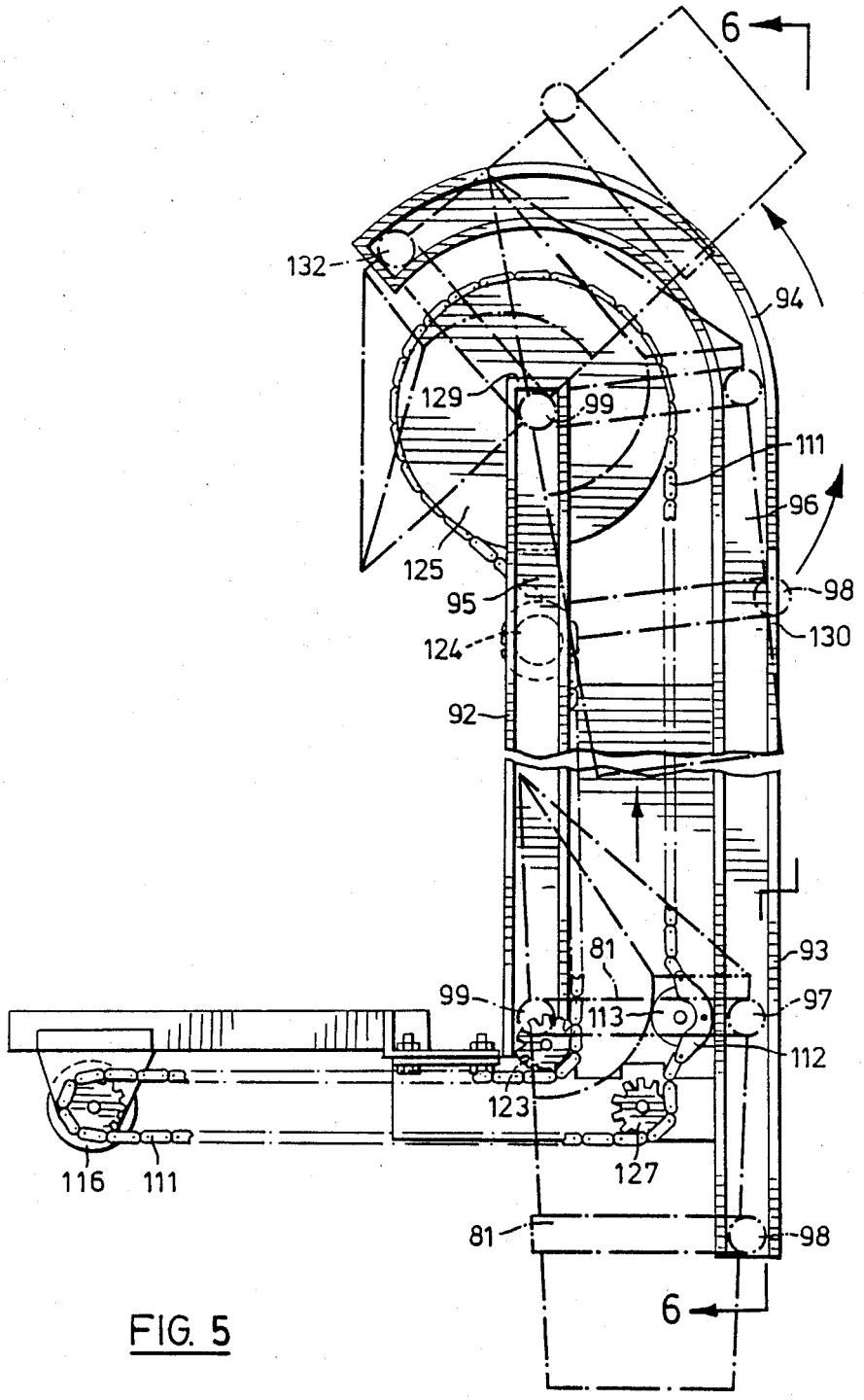
FIG. 5 is a detail side elevation showing the structure and operation of the preferred guide and lift means.
Figure 6:
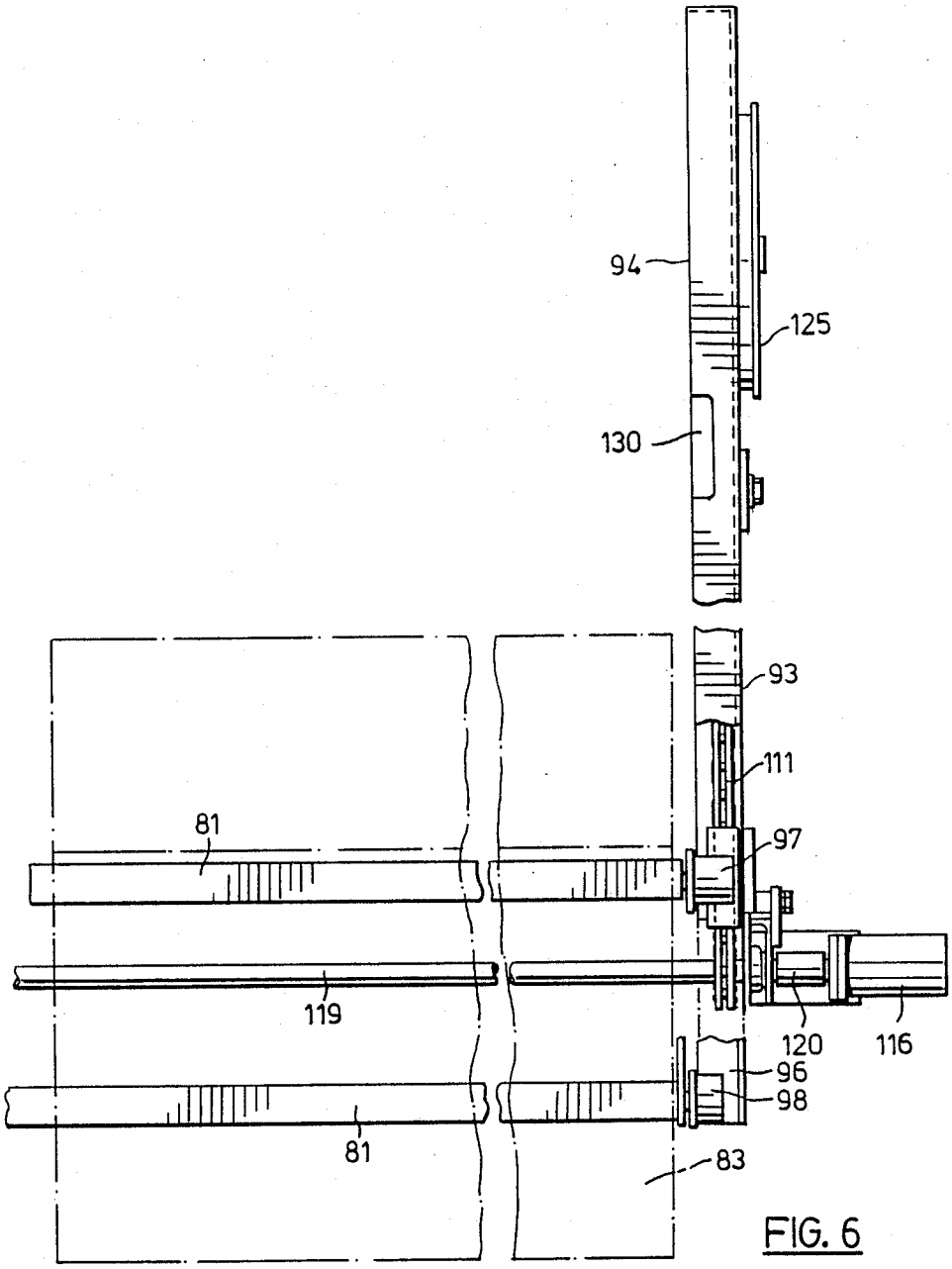
FIG. 6 is a detail view taken along line 6—6 in FIG. 5.

The trough 80 is mounted with a guide and lift means 90 which preferably comprises an endless chain and sprocket arrangement at each end of the trough 80. As shown in FIG. 5, each guide and lift means 90 is attached to the curb sidewall 32 and comprises an inner track 92 positioned upright along the sidewall 32 and an outer track 93 spaced parallel in front of the inner track 92. The outer track 93 has an upper curved portion 94 extending above the roof 20 of the body 10. Preferably, the curved portion 94 of the outer track 93 curves through an arc of about 130°. Each track 92 and 93 defines a channel 95 and 96 for receiving rollers 97, 98 and 99 attached to the frame 81 at the end of the trough 80. The channel 96 is preferably deeper than the channel 95. The upper roller 97 attached to the top frame member 81 has a width from front to back approximating the depth of channel 96 in the outer track 93, while the lower roller 98 attached to the bottom frame member 81 has a width approximately half that of the roller 97 (see FIG. 6).

The trough 80 is moved along the tracks 92 and 93 by a chain drive comprising an endless chain 111 attached by means of a connector 112 to a trough carrier 113 which is in turn attached to the upper frame member 81 of the trough 80. Each guide and lift means 90 has a motor 116 mounted to the truck frame 14 beneath the floor 36 of the body 10. The motors 116 are preferably high torque, low speed hydraulic motors. The opposing motors 116 at either end of the body 10 are connected by a shaft 119 and a coupling 120 at either end for synchronization of the chain drives of each guide and lift means 90. The chain 111 extends from the motor 116 to lower and upper idler sprocket wheels 123 and 124 located toward the lower and upper ends of the inner track 92. The chain 111 then extends over a large top wheel 125 centered within the arc of the curved portion 94 of the outer track 93 and then downwardly along the inside of the track 93 to the connector 112 and a chain tightener sprocket wheel 127 before completing the circuit back to the motor 116.

In operation, the guide and lift means 90 at either end of the trough 80 raise the trough 80 by activating the motors 116 to cause the chain 111 to travel upwardly along the inner edge of the outer rail 93 and downwardly along the outer edge of the inner rail 92. The inner rail 92 has a stop 129 at its top so that the roller 99 centers on the center of the wheel 125 when the trough 80 is lifted to that point. The outer rail 93 has an opening 130 (FIG. 6) just below the upper curved portion 94 to allow the thin lower roller 98 to move out of the track 93 as the trough 80 is carried around the curved portion 94 of the track 93, thereby inverting the trough 80 above the roof 20 of the body 10. Movement of the trough 80 is limited by a stop 132 at the end of the track 93 which engages the wide roller 97. The trough 80 is lowered by reversing the motors 116.

Figure 7:
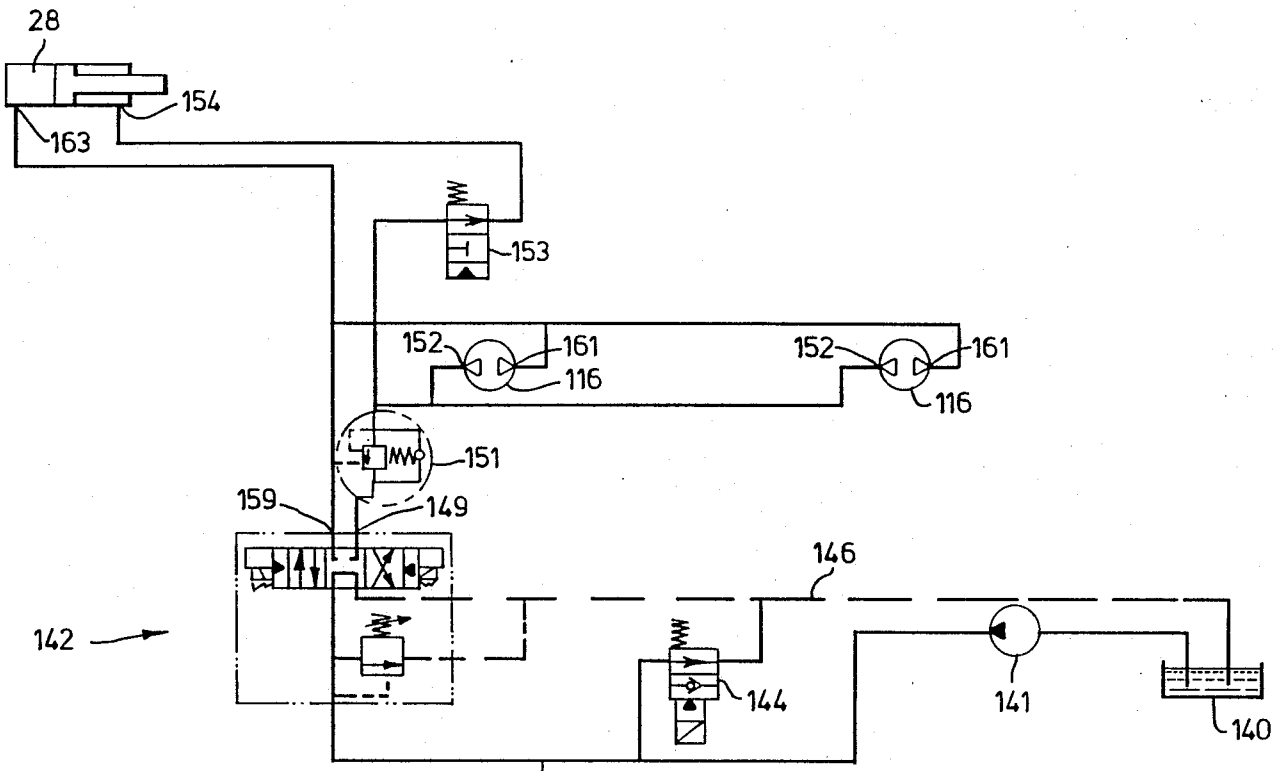
FIG. 7 is a schematic diagram of a preferred hydraulic control system for the invention.

A control system for the hydraulic motor 116 and the hydraulic cylinder 28 which operates the roof panel 24 is shown in FIG. 7. The control system operates to ensure that the trough 80 is not raised unless the panel 24 is open.

Referring to FIG. 7, hydraulic oil is pumped out of a tank 140 by a pump 141 to a four way control valve 142. An unloading valve 144 is provided ahead of the control valve 142, and the valve 144 connects the pressure line 145 from the pump 141 and the return line 146 from the control valve 142 which runs back to the tank 140. This unloading valve 144 is used to prevent operation of the guide and lift means 90 while the truck is being driven. The valve 144 is solenoid operated and is normally open when the truck is in gear. Moving the gearshift of the truck to the neutral position energizes the solenoid to close the valve 144 allowing hydraulic pressure sufficient to operate the control valve 142.

In the lift cycle for the guide and lift means 90, hydraulic fluid proceeds from the control valve 142 through outlet 149 and through a load control valve 151 to pressurize the hydraulic motors 116 via ports 152. Hydraulic fluid simultaneously flows through an open lock valve 153 to port 154 of the roof cylinder 28 which operates the roof panel 24. In the preferred embodiment herein described it requires about 150 psi to open the roof panel 24, whereas it requires about 500 psi hydraulic pressure to lift the trough 80. Thus, simultaneously pressurization of the cylinder 28 and the motors 116 enables the roof panel 24 to open safely ahead of the arrival of the trough 80 for dumping. The lock valve 153 closes when the trough 80 is lifted to the stops 129 at the top of the inner tracks 92, thus locking the roof panel 24 in the open position. The roller 99 activates a switch closing the valve 153.

In lowering the trough 80, hydraulic fluid is pumped through the outlet 159 of the control valve 142 to ports 161 of the motors 116 and to port 163 of the cylinder 28. The roof panel 24 remains fully open until the trough rotates back through the curved upper portion 94 of the outer track 93 allowing the roller 99 to disengage the switch closing the locking valve 153. As the trough 80 moves down the tracks 92 and 93, the locking valve 153 opens, and the roof panel 24 closes.

The load control valve 151 operates to create back pressure against the ports 152 of the motors 116 so that a runaway free fall of the trough 80 is prevented.

While the foregoing description has been directed to the preferred embodiment, the invention encompasses general principles which are particularly set out in the following claims.

We claim:

1. A truck body comprising:

a floor, first and second opposing sidewalls, front and rear walls, and a roof;

a plurality of interior partitions each extending substantially from roof to floor and first to second sidewall transversely of the body, thereby defining a plurality of truck body compartments, each partition being hinged at its top edge to allow the partition to pivot toward the rear of the body;

means for positioning the interior partitions at a plurality of different locations longitudinally along the body;

means for locking each interior partition in place;

a door in the rear wall providing access through a major portion of the rear wall to the interior of the body;

a movable panel in the roof, the panel being hinged centrally longitudinally substantially along the entire length of the roof, and means for moving the panel to provide access to the interior of the body;

a trough extending along one side of the body, the trough defining a plurality of buckets in corresponding relation to the interior compartments of the body; and guide and lift means for moving the trough vertically along the side from a position near the bottom of the side to an inverted position above the top of the side, said guide and lift means enabling contents of the trough to be dumped into the partitioned interior of the body when the movable roof panel is opened, the guide and lift means comprising a track attached to and extending upright along a sidewall at each end of the trough; a roller attached to each end of the trough for engaging each track, the track and roller at each end of the trough coacting to guide the trough upwardly and downwardly along the sidewall of the body; a chain attached at each end of the trough, each chain extending uprightly along the sidewall adjacent each rail; and sprocket wheels and motor means for driving each chain to lift and lower the trough.

2. A truck body as claimed in claim 1, wherein each interior partition has a hinge pin extending laterally from each top corner, and the means for positioning the interior partitions comprises a rail extending along each sidewall near the top edge thereof, each rail having a plurality of spaced slots for receiving partition hinge pins.

3. A truck body as claimed in claim 1, wherein the means for locking each partition comprises locking rods connected to a mechanical linkage and pockets defined in the opposing sidewalls for receiving the ends of the rods when they are extended laterally beyond the sides of the partition by operating the linkage.

4. A truck body as claimed in claim 3, wherein the linkage is spring biased toward the locked position with the rods being extended into the sidewall pockets.

5. A truck body as claimed in claim 4, wherein a pneumatic cylinder coacts with the linkage to retract the rods from the sidewall pockets.

6. A truck body as claimed in claim 1, wherein the movable panel in the roof is opened and closed by means of a hydraulic cylinder.

7. A truck body as claimed in claim 1, wherein the trough comprises a plurality of movable buckets.

8. A truck body as claimed in claim 1, wherein each guide and lift means comprises an inner track and an outer track spaced parallel in front of the inner track, the outer track having an upper curved portion extending above the roof of the body and curving in a circular arc toward the roof, each track defining a channel; rollers attached to each end of the trough coacting with the tracks and running in the channels to guide the trough as it moves along the sidewall of the body; and each chain extending uprightly along the sidewall and over a wheel centered within the arc of the curved upper portion of the outer track.

9. A truck body as claimed in claim 8, wherein the chains are driven by a motor.

10. A truck body as claimed in claim 8, wherein each chain is driven by a high torque, low speed hydraulic motor, the motors being connected to one another by a shaft so that they operate in synchrony.

11. A truck body as claimed in claim 8, wherein the upper curved portion of the outer track has a circular curvature of about 130°.

12. A truck body as claimed in claim 8, wherein a stop is provided at the curved end of the outer track to limit the travel of the trough.

13. A truck body as claimed in claim 8, wherein a stop is provided at the top of the inner track coinciding with the center of the wheel centered within the arc of the curved upper portion, so that the roller running in the channel of the inner track coacts with the stop to allow the trough to pivot about the curved upper portion thereby inverting.

14. A truck body as claimed in claim 8, wherein the chain is endless.

15. A truck body as claimed in claim 8, wherein the chain of each guide and lift means is endless and is driven by a separate motor, the operation of the motors being synchronized.

16. A truck body as claimed in claim 15, wherein the motors are high torque, low speed hydraulic motors connected to one another by a shaft to provide synchronous operation.

* * * * *